US005716491A

United States Patent [19]

Arimoto

[11] Patent Number: 5,716,491

[45] Date of Patent: Feb. 10, 1998

[54] SPLICING GAUGE

[75] Inventor: Keigo Arimoto, Wakayama, Japan

[73] Assignee: Noritsu Koki Co., Ltd., Wakayama, Japan

[21] Appl. No.: 587,383

[22] Filed: Jan. 17, 1996

[30] Foreign Application Priority Data

Jan. 17, 1995 [JP] Japan ..... 7-004933
Jan. 17, 1995 [JP] Japan ..... 7-004938

[51] Int. Cl.[6] ..... B65H 21/00

[52] U.S. Cl. ..... 156/502; 156/159; 156/304.3; 156/304.5; 156/505; 156/513

[58] Field of Search ..... 156/159, 304.3, 156/304.5, 502, 505, 513

[56] References Cited

U.S. PATENT DOCUMENTS

| | | | |
|---|---|---|---|
| 1,781,200 | 11/1930 | Spiros | 156/502 X |
| 3,533,891 | 10/1970 | Puyear | 156/159 X |
| 3,833,447 | 9/1974 | Gustafson | 156/505 |
| 4,368,096 | 1/1983 | Kobayashi | 156/159 X |
| 5,354,408 | 10/1994 | Otomine et al. | 156/505 |

FOREIGN PATENT DOCUMENTS

| | | | |
|---|---|---|---|
| 154748 | 10/1938 | Austria | 156/502 |
| 1597661 | 5/1970 | Germany | 156/159 |
| 52-3425 | 1/1977 | Japan | 156/502 |
| 1-102566 | 4/1989 | Japan | 156/505 |

*Primary Examiner*—Mark A. Osele
*Attorney, Agent, or Firm*—Wenderoth, Lind & Ponack

[57] ABSTRACT

A splicing gauge connects a film to a leader with high reliability. A film container support is provided at one end of a leader supporting surface of a splicing table. A fixed blade and a movable blade are provided between the container support and the leader supporting surface. A film pulled out of a film container is cut by moving the movable blade toward the fixed blade. A leader placed on the leader supporting surface is positioned relative to the cut edge of the film. A splicing tape is stuck on both the leader and the film. The leader is then turned over by 180° about the film container to support it on a backside splicing table provided at one end of the container support. Another splicing tape is put on the backsides of the leader and the film.

7 Claims, 10 Drawing Sheets

SPLICING GAUGE

BACKGROUND OF THE INVENTION

This invention relates to a splicing gauge for splicing an undeveloped film pulled out of a film container such as a patrone or a film magazine to a leader.

As shown in FIG. 10, to automatically develop a film F pulled out of a film container A by guiding it through an automatic film developing machine, the film F and a leader L are spliced together by an adhesive tape T. In this state, the film F, led by the leader L, is fed into the developing machine.

The leader L is made of a flexible synthetic resin and has square holes h provided along both sides thereof at equal intervals and adapted to engage sprockets.

A splicing gauge is used to connect or splice the film F to the leader L.

Unexamined Japanese Patent Publication 1-102566 discloses such a splicing gauge. It has a film container support provided on one side of a leader supporting surface of a splicing table, and fixed and movable blades for cutting a film pulled out of the film container supported on the film container support onto the leader supporting surface. After positioning the leading edge of the leader placed on the leader supporting surface with respect to the cut end of the film, the film and the leader are connected together by sticking a splicing tape to both of them.

In such prior arrangements, the film and the leader are connected together by sticking a splicing tape on only one side of the film and the leader.

An object of this invention is to provide a splicing gauge which can connect a film to a leader with high reliability.

SUMMARY OF THE INVENTION

According to this invention, there is provided a splicing gauge comprising a splicing table having a leader supporting surface on which a leader is placed, a film container support provided at one side of the leader supporting surface for supporting a film container, a fixed blade and a movable blade provided between the container support and the leader supporting surface. The movable blade is movable relative to the fixed blade for cutting in cooperation with the fixed blade a film pulled out of the film container. A leader positioning protrusion positions the leading end of the leader at the position where the film is cut. A splicing tape may be positioned on both the leader positioned by the leader positioning protrusion and the film cut by the movable blade. A backside splicing table is provided at one side of the container support for supporting the leader when it is turned over.

The backside splicing table may be provided thereon with a protrusion for positioning the leading end of the leader and protrusions for positioning both sides of the leader, the protrusion for positioning the leading end of the leader being formed with a recess in which the film is adapted to fit.

The film pulled out of the film container onto the leader supporting surface is cut at its leading end by the movable blade. The film thus cut is connected to the leader placed on the leader supporting surface by sticking a splicing tape on the leader and the film. The leader is then turned over until it is placed on the backside splicing table. In this state, another splicing tape is stuck on the backsides of the leader and the film. They are thus securely connected together with higher reliability than if a splicing tape is applied on one side only.

The film thus connected to the leader can be fed smoothly and reliably through the film feed path in the film developing unit. When the leader is turned over by 180° together with the film, the leader and film will not incline relative to each other because the leading end and both sides of the leader are positioned by the positioning protrusions provided on the backside splicing table. Thus, the film and the leader can be connected together with high accuracy by application of a splicing tape on the backside splicing table.

Other features and objects of the present invention will become apparent from the following description made with reference to the accompanying drawings, in which:

DETAILED DESCRIPTION OF THE PREFERRED EMBODIMENTS

Figure 1:
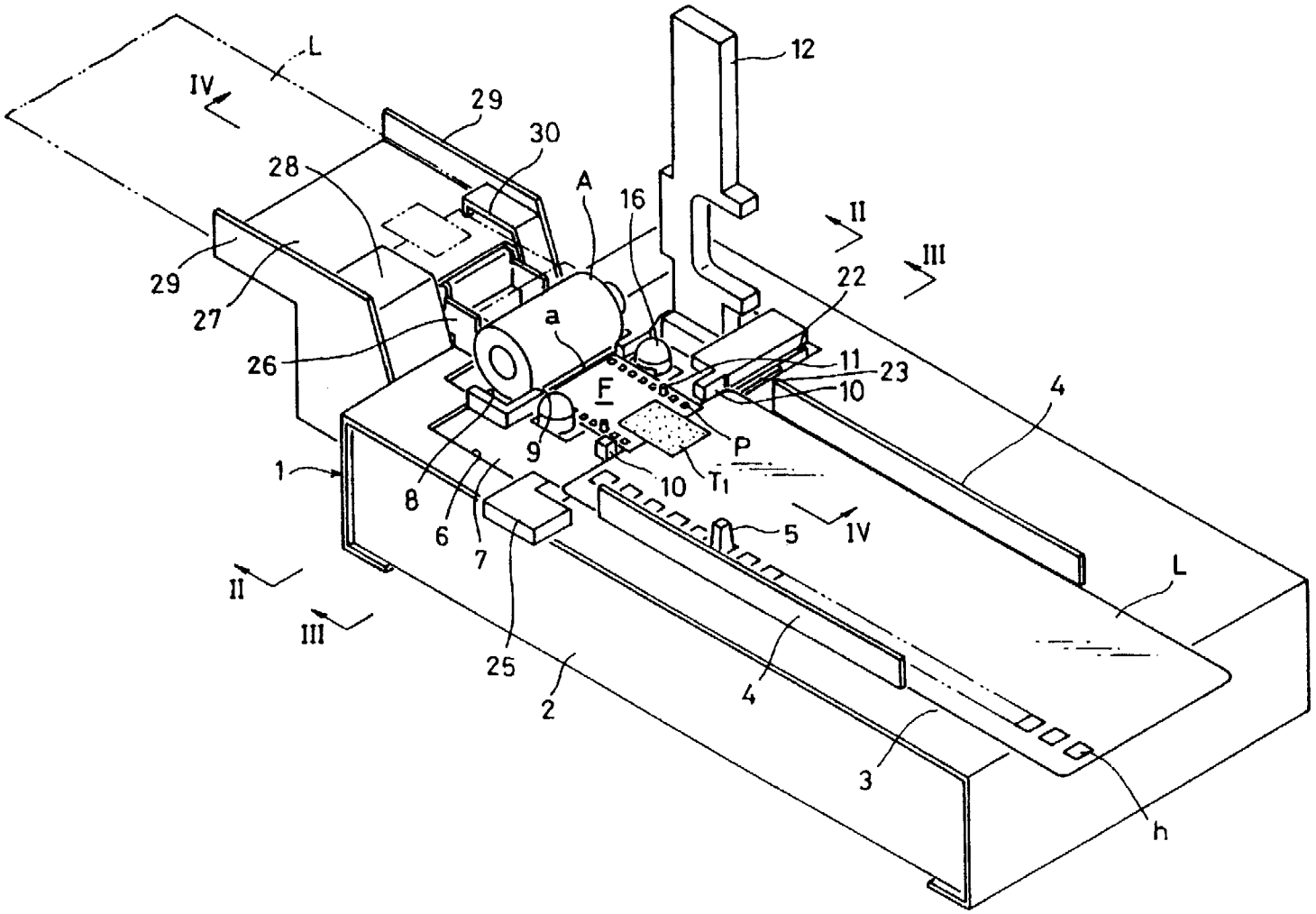
FIG. 1 is a perspective view of one embodiment of the splicing gauge according to this invention.

An embodiment of this invention is now described with reference to FIGS. 1–6B.

As shown in FIGS. 1–4, a splicing table 1 is a box-shaped member having a front opening. A drawer 2 is inserted therein through the front opening.

The splicing table 1 has a leader supporting surface 3 on which is supported a leader L. Provided on the leader supporting surface 3 are a pair of leader rulers 4 for positioning the sides of the leader L and a leader positioning protrusion 5 adapted to engage one of square holes h formed in the leader L.

A window 6 is formed in the leader supporting surface 3 at one side thereof. Under the window 6, a knife mount 7 is screwed or otherwise fixed to the underside of the splicing table 1.

Figure 4:
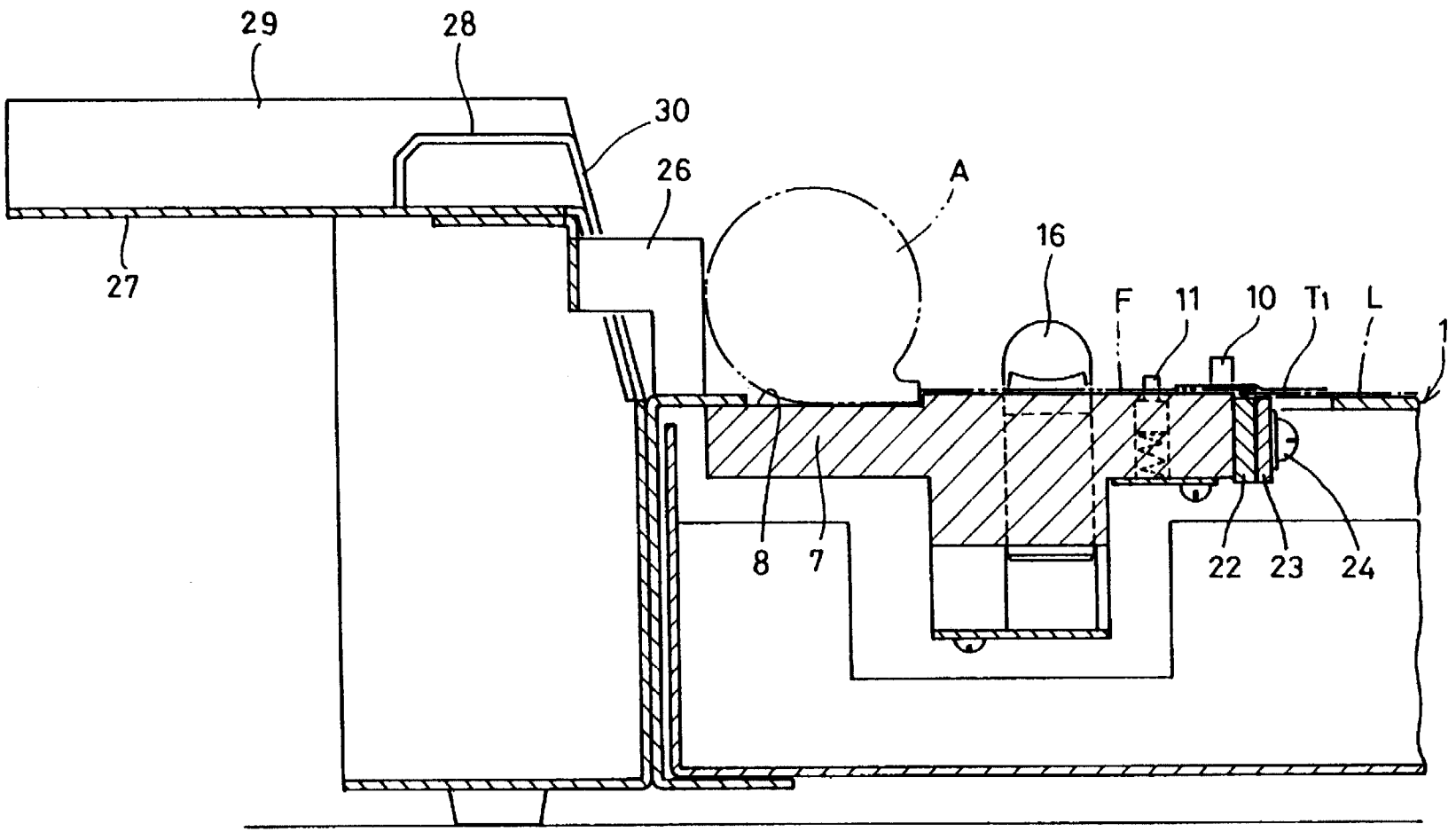
FIG. 4 is a sectional view taken along line IV—IV of FIG. 1.

The knife mount 7 is formed with a recess as a film container support 8 (FIG. 4). The wall defining the container support 8 has a cutout 9 for positioning a film opening or slot a of a film container A.

Provided at the other end of the top surface of the knife mount 7 are a pair of leader positioning protrusions 10 transversely separated from each other by a distance sufficient to allow the film F to pass therebetween. They are used to position a leading edge of the leader L placed on the leader supporting surface 3.

Figure 2:
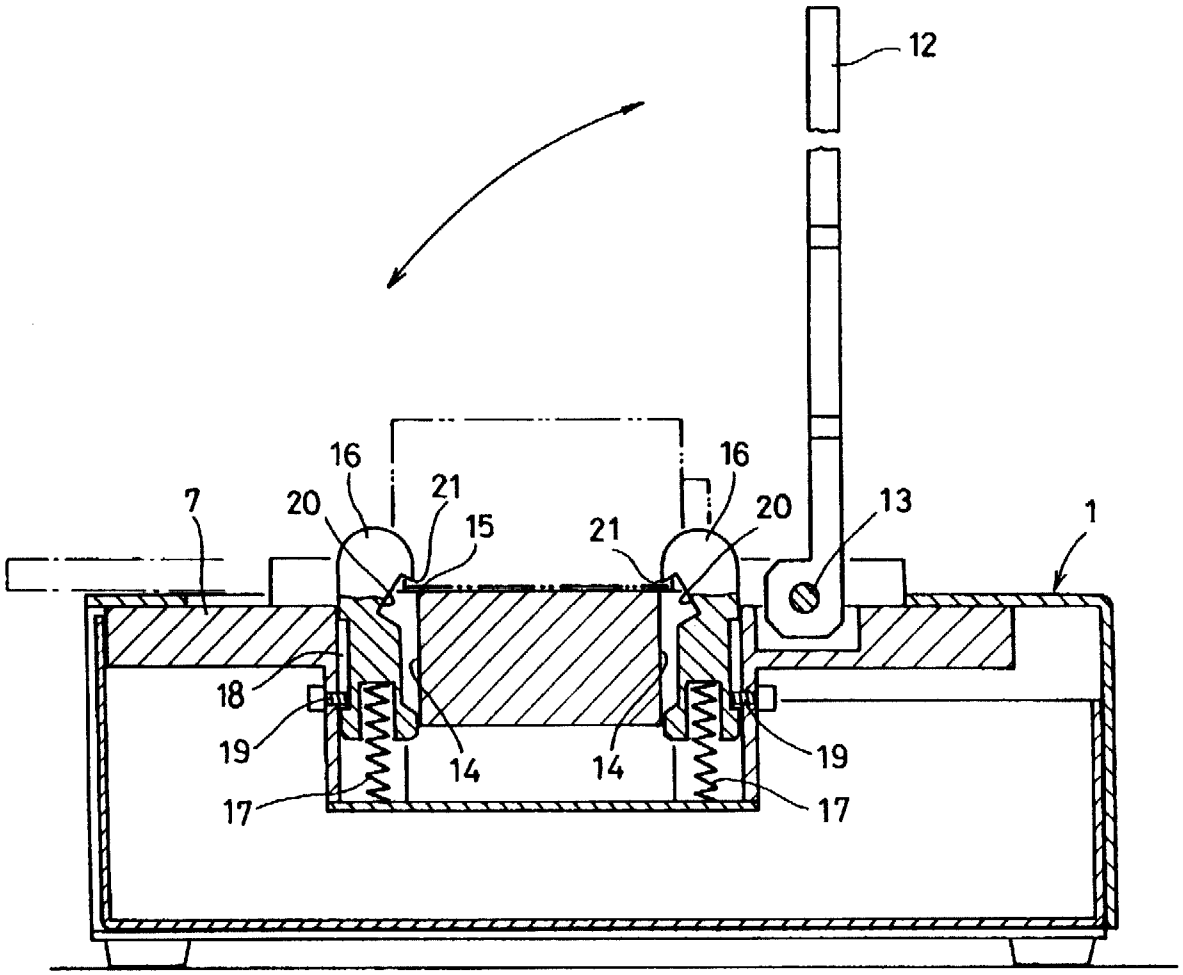
FIG. 2 is a sectional view taken along line II—II of FIG. 1.

The film F pulled out of the film container A on the support 8 onto the leader supporting surface 3 is positioned by inserting the positioning pins 11 in perforations P of the film F and pressing by a film presser arm 12. As shown in FIG. 2, the film presser arm 12 has one end thereof coupled to the knife mount 7 so as to be pivotable about pin 13.

The knife mount 7 is formed, in its area where the film presser arm 12 is superposed, with a pair of pin holes 14 transversely separated from each other by a distance equal to the width of the film F.

Each pin hole 14 has a top edge as a cutting edge 15. In each pin hole 14 are received a punching pin 16 and a resilient member 17 biasing the pin 16 upwardly. The punching pin 16 is pushed down against the resilient member 17 by the presser arm 12.

As shown in FIG. 2, rotation of each punching pin 16 is prevented by engaging a pin 19 formed on the inner surface of the pin hole 14 in a groove 18 formed in the outer periphery of the pin 16.

Also, the punching pins 16 have recesses 20 formed in their upper portions at positions to face each other. They are provided to prevent the pins 16 from interfering with the film F. The top edges of the recesses 20 serve as cutting edges 21 for forming cutouts in the film.

Figure 3:
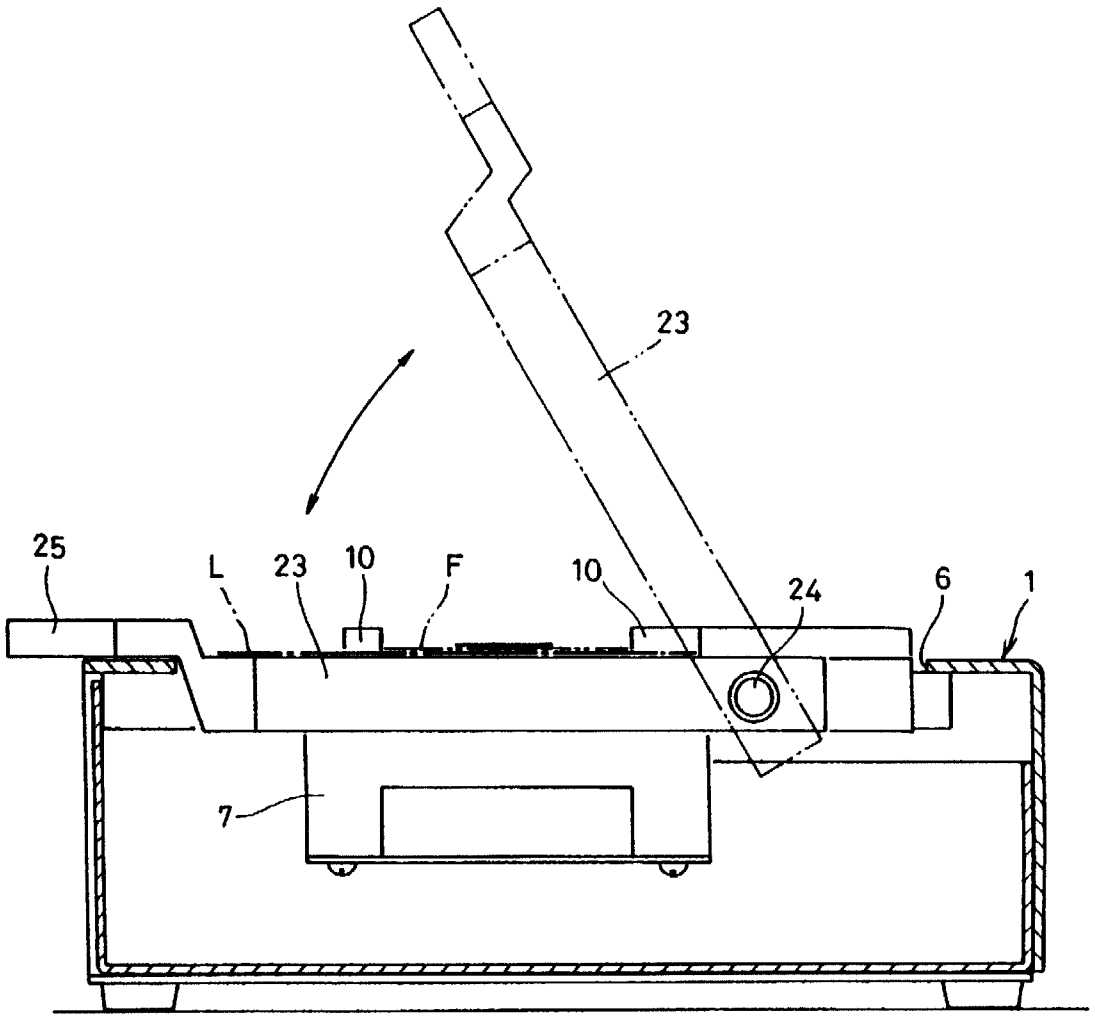
FIG. 3 is a sectional view taken along line III—III of FIG. 1.

A fixed blade 22 is mounted on the knife mount 7 at its other end as shown in FIG. 4. The film F is cut transversely by the fixed blade 22 and a movable blade 23 whose one end is pivotally coupled to the fixed blade 22 by means of a pin 24 as shown in FIG. 3. The movable blade 23 carries a handle portion 25 at its other end.

At the other end of the film container support 8, there are provided a stopper frame 26 for preventing the film container A supported on the container support 8 from moving toward the other end of the container support 8, and a backside splicing table 27 for supporting the leader when it is turned over by 180° about the film container A from the position where it is placed on the leader supporting surface 3.

The backside splicing table 27 has on its top surface a protrusion 28 for positioning the leading edge of the leader L and side portioning ribs 29 for positioning the side edges of the leader L. The protrusion 28 has a recess 30 in which the film F fits.

Figure 6B:
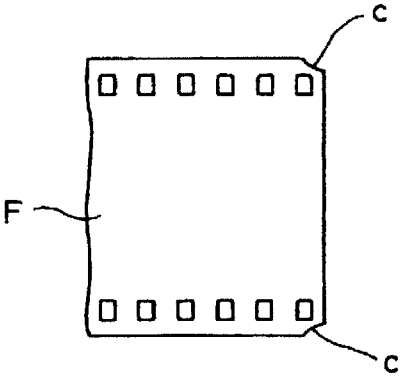
FIG. 6B is a plan view of a film separated from a leader.
Figure 6A:
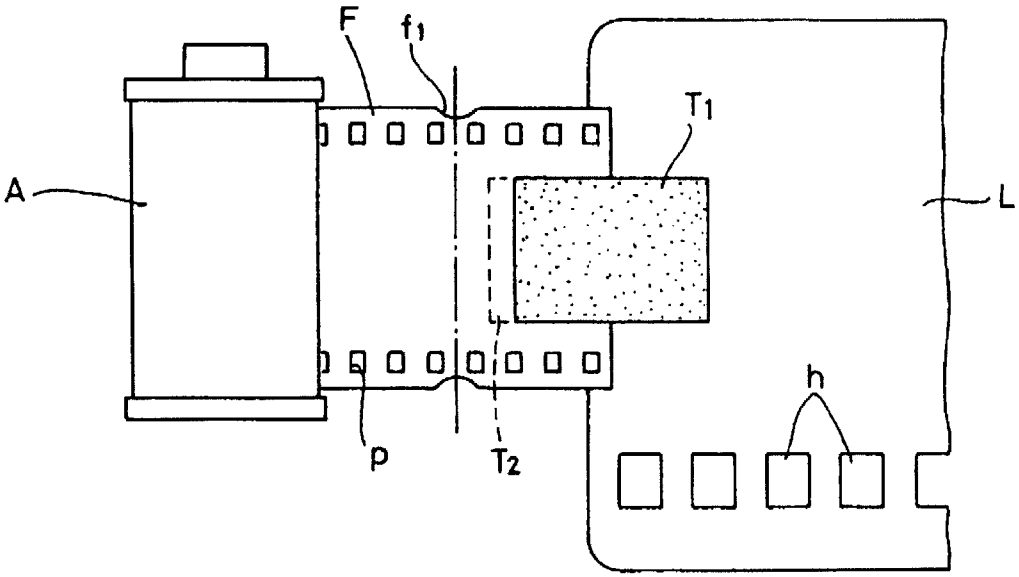
FIG. 6A is a plan view of a leader connected to a film.

The film F is pulled out of the film container A placed on the film support 8 so that sides of film F are inserted in the recesses 20 formed in the punching pins 16 (FIG. 2). The positioning pins 11 are inserted in two perforations P of the film F to position the film F. In this state, the presser arm 12 is pivoted downward to push down the punching pins 16. Semicircular cutouts f1 are thus formed in the film F along both side edges as shown in FIG. 6A.

By pivoting the movable blade 23 downward with the film pressed by the film presser arm 12, the film F is cut transversely by the movable blade 23 and the fixed blade 22. The film can be cut with high accuracy because it is pressed by the arm 12.

After cutting the leading end of the film F, the leader L is placed on the leader supporting surface 3 so that the leader positioning protrusion 5 is inserted in one of the square holes h. In this state, the film F and the leader L are connected together by sticking a splicing tape T1 to both the leader L and the film F.

Figure 5:
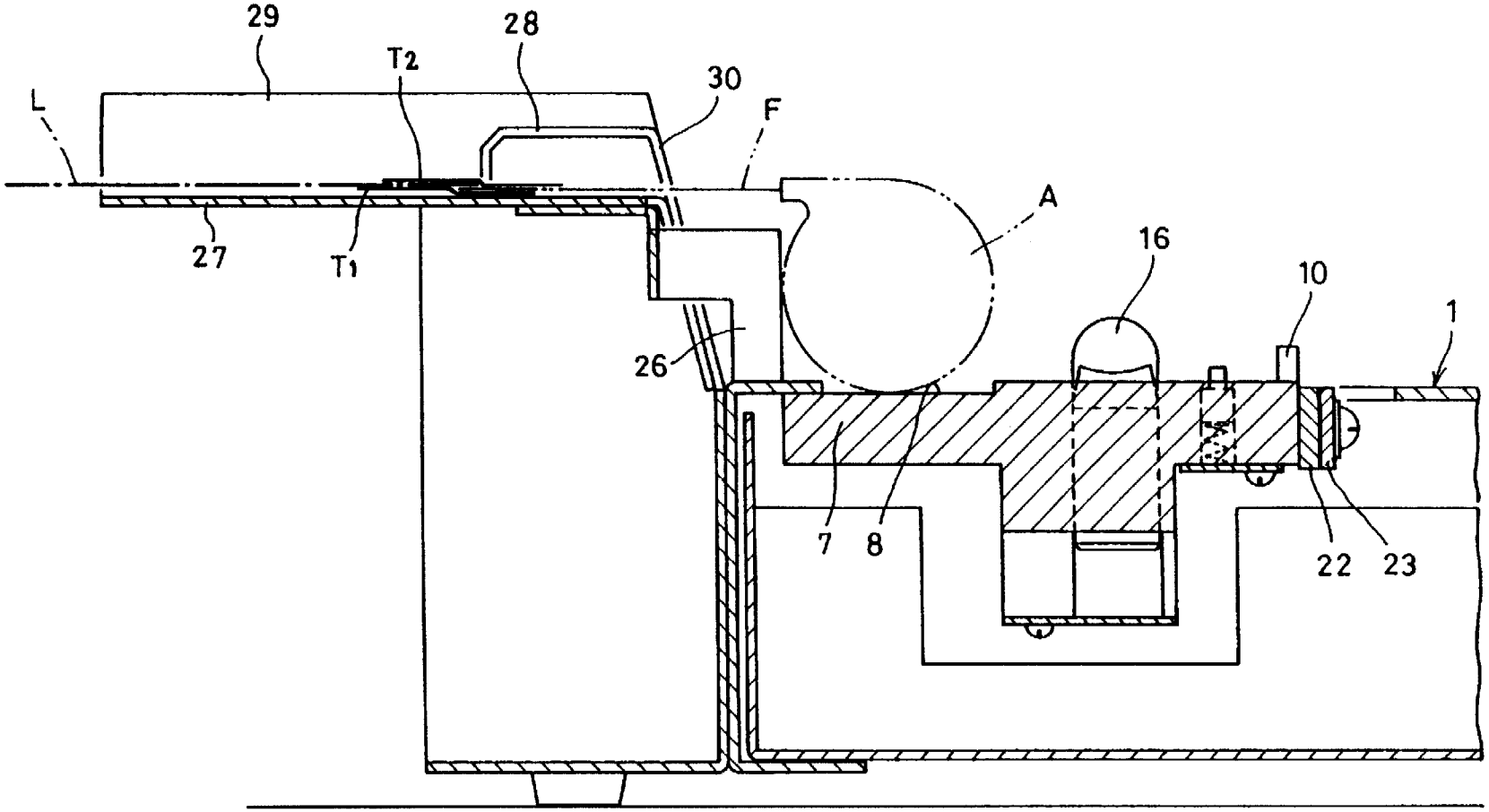
FIG. 5 is a sectional view similar to FIG. 4 but with a leader turned.

With the film F connected to the leader L, the leader L is turned over by 180° about the film container A to place it on the backside splicing table 27 as shown in FIG. 5. In this state, another splicing tape T2 is put on the backsides of the leader L and the film F.

When the leader L is turned 180°, the film F fits in and is positioned by the recess 30, while the leader is positioned by the leading edge positioning protrusion 28 and the side edge positioning ribs 29. Thus, the leader L and the film F will be aligned relative to each other when the leader is turned over. By sticking the second tape T2 in this state, the leader L and the film F can be connected together with high accuracy.

The film F thus connected to the leader L is fed through the film developing machine, led by the leader. The film thus developed is cut along the line connecting the cutouts f1 shown by the chain line in FIG. 6A. Chamfers c are formed at the front two corners of the film F thus cut (FIG. 6B). Since the film is chamfered at the front corners, it can be fed smoothly in a printing machine without getting stuck in the film feed path in the negative mask of the printing machine.

Figure 7:
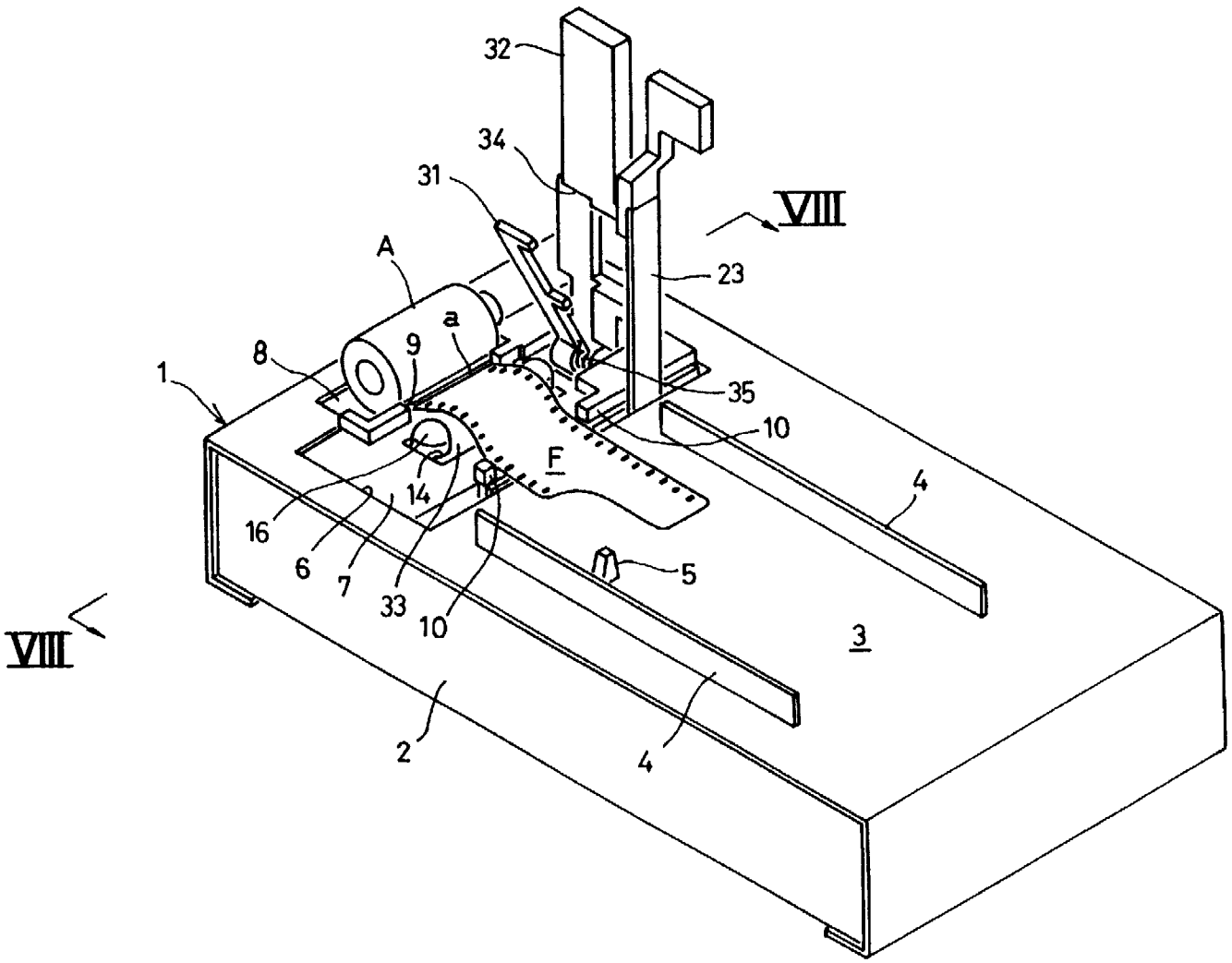
FIG. 7 is a perspective view of a second embodiment of the splicing gauge according to this invention.
Figure 8:
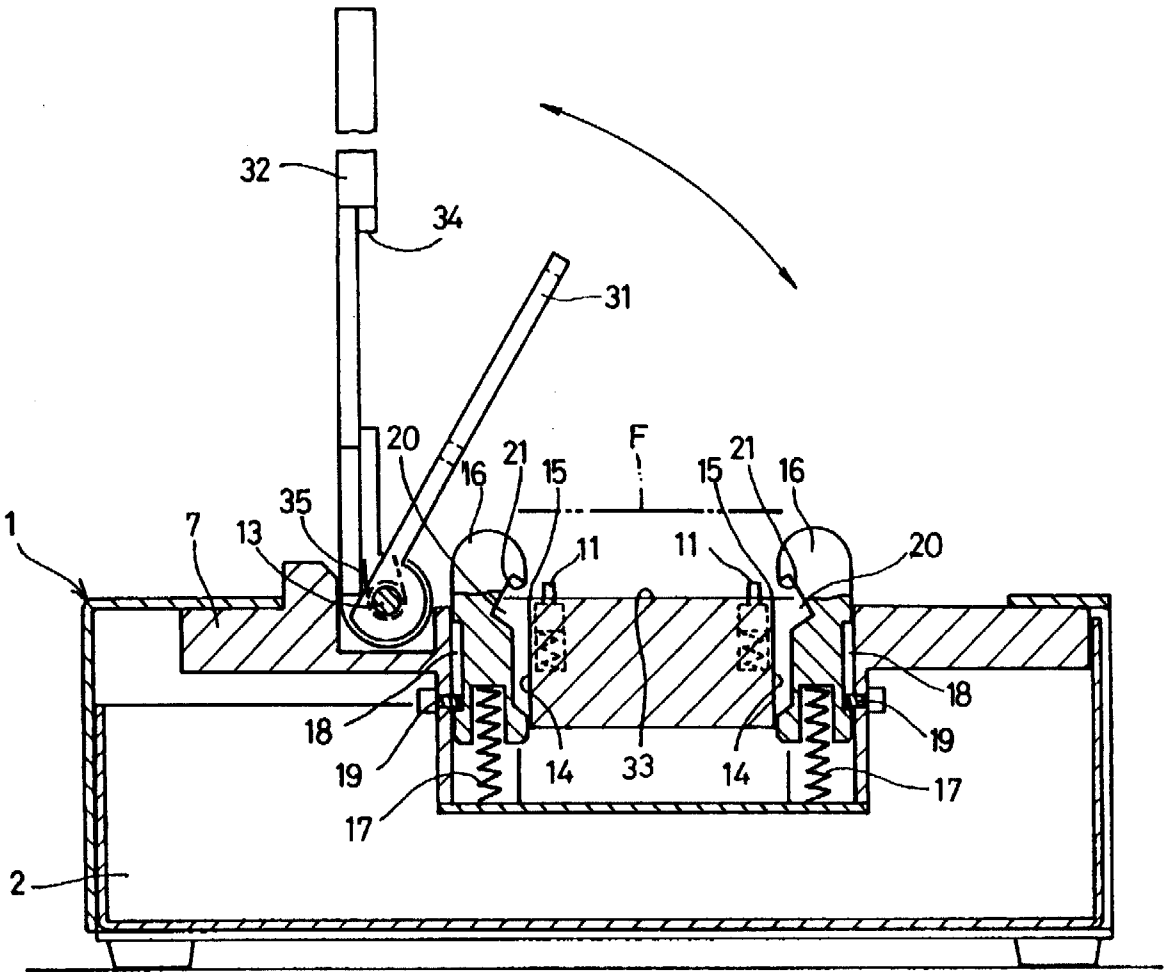
FIG. 8 is a sectional view taken along line VIII—VIII of FIG. 7.

In the second embodiment as shown in FIGS. 7–9, the film F is pulled out from the film container A on the film container support 8 to the leader supporting surface 3. The film is then supported on a film supporting portion 33 at which a pair of film positioning pins 11 and a pair of pin holes 14 are provided.

The arrangement and structure of the film positioning pins 11, pin holes 14 and the punching pins 16 are substantially the same as in the first embodiment.

In the second embodiment, a first film presser arm 31 and a second presser arm 32 are provided on the knife mount 7. They are pivotally coupled at one end thereof to the knife mount 7 through a pin 13.

The second film presser arm 32 has a film pressing surface in which is formed a recess 34 which can receive the first presser arm 31. With the first presser arm 31 received in the recess 34, the film pressing surface of the arm 31 is flush with that of the arm 32.

A resilient member 35 which is a kick spring is mounted on the pin 13. It urges the first and second film presser arms 31 and 32 to pivot in opposite directions relative to each other. As shown in FIG. 8, the arms 31 and 32 are in engagement with each other at the one end thereof so that their spread angle is limited.

The first film presser arm 31 presses the film F near the punching pins 16 when it is pivoted downward.

By pivoting the second presser arm 32 downward, it pushes down the punching pins 16 first and then presses the film F.

In this embodiment, the downward pivoting motion of the second film presser arm 32 is transmitted to the first presser arm 31 through the resilient member 35. But the resilient member 35 may be omitted. In this case, the first and second presser arms 31 and 32 are pivoted separately.

In operation, a film F is pulled out of a film container A placed on the container support 8 toward the leader supporting surface 3. Then, the second film presser arm 32 is pressed down.

The downward pressure applied to the second film presser arm 32 is transmitted to the first film presser arm 31 through the resilient member 35, so that both arms 31 and 32 are pivoted downward. The film F is thus pushed down by the first film presser arm 31.

Figure 9A:
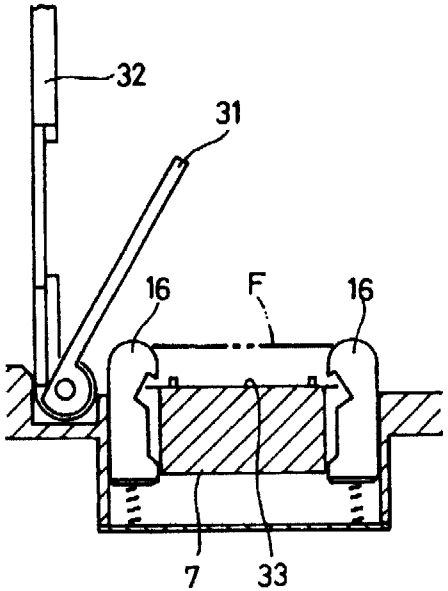
FIGS. 9A to 9D are views showing how notches are formed in the film.
Figure 9B:
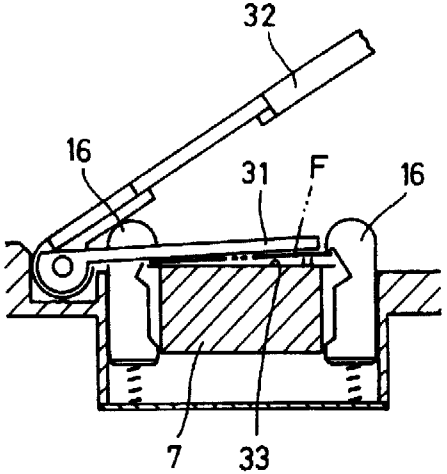
Figure 9C:
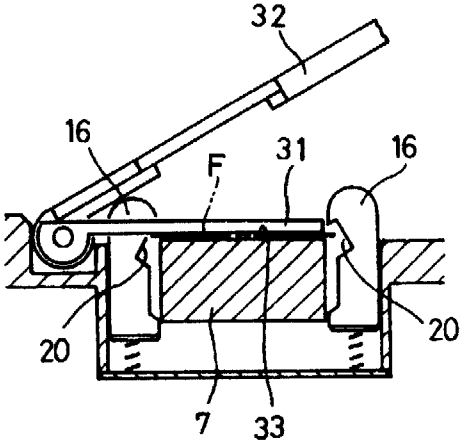

That is, the film F, which is initially supported on the tops of the punching pins 16 as shown in FIG. 9A, is pushed down by the first film presser arm 31 until it is pressed against the top surface of the knife mount 7 with its side edges received in the recesses 20 of the punching pins 16 as shown in FIG. 9C.

Figure 9D:
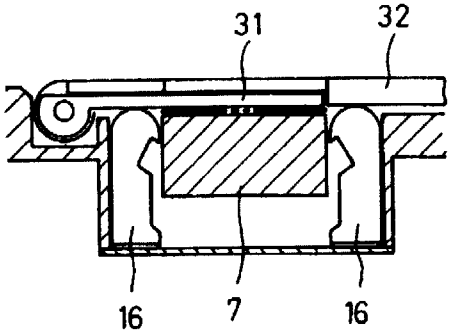
Figure 10:
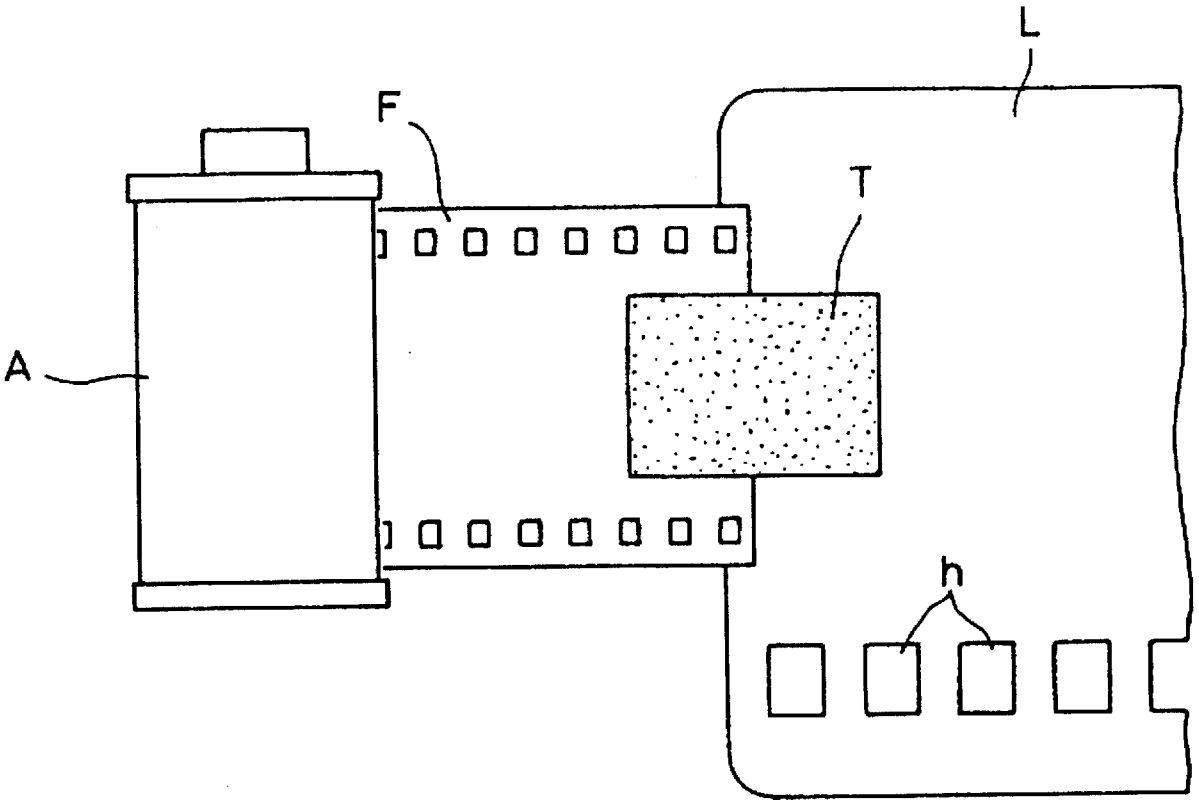
FIG. 10 PRIOR ART
FIG. 10 is a plan view of a leader and a film connected together with a conventional method.

By further pivoting the second film presser arm 32 downward, it engages and pushes down the punching pins 16 before it is pressed against the film F as shown in FIGS. 9C and 9D. While being pushed down by the arm 32, the punching pins 16 form notches f1 on both sides of the film F as shown in FIG. 6A.

The film F pressed by the arms is then cut transversely by pivoting the movable blade 23 downward. The film is then connected to the leader L in the same manner as in the first embodiment.

After developing the film F in a developing machine, it is separated from the leader L by cutting the film in the same manner as in the first embodiment.

In this embodiment, even if the film is initially supported on tops of the punching pins 16 as shown in FIG. 9A, it can be pushed down by the first film presser 31 so that its sides are received in the recesses formed in the punching pins 16 before the punching pins are pushed down by the second film presser arm 31. Thus, it is possible to form notches in each film without fail.

By providing the resilient member which biases the first and second film presser arms in opposite directions, it is possible to push down both arms simultaneously by pushing only the second film presser arm. Working efficiency is thus high.

What is claimed is:

1. A splicing gauge for use in splicing a film to a leader, said splicing gauge comprising:

a splicing table having first and second leader supports for supporting a leader;

a film container support positioned between said first and second leader supports for supporting a film container;

a fixed blade and a movable blade positioned between said film container support and said first leader support, said movable blade being movable relative to said fixed blade for cutting in cooperation with said fixed blade a film pulled out of a film container supported on said film container support; and a positioning protrusion on said first leader support for positioning a leading end of a leader that is supported on said first leader support at a location whereat the film is cut by said fixed and movable blades;

whereby a first splicing tape may be applied to the leader positioned by said positioning protrusion at said location and the cut film, whereafter the leader may be turned over to be supported on said second leader support, and a second splicing tape may be applied to the leader and the cut film.

2. A splicing gauge as claimed in claim 1, wherein said first and second leader supports comprise respective first and second surfaces.

3. A splicing gauge as claimed in claim 1, further comprising an end positioning protrusion on said second leader support for positioning the leading end of the leader when the leader is supported on said second leader support.

4. A splicing gauge as claimed in claim 3, wherein said end positioning protrusion has therein a recess for receiving therein the cut film.

5. A splicing gauge as claimed in claim 3, further comprising side positioning protrusions on said second leader support for positioning opposite sides of the leader.

6. A splicing gauge as claimed in claim 1, further comprising a film support for supporting the film pulled out of the film container toward said first leader support, said film support having therein a pair of pin holes at locations to be at opposite edges of the film, said pin holes having opening edges defining cutting edges, punching pins positioned in respective said pin holes and urged outwardly thereof by respective resilient members, each said punching pin having a recess formed in an inner upper portion thereof, said recess having an upper cutting edge, and a film presser arm pivotally mounted on said film support for movement to press said punching pins inwardly of said pin holes against the biasing force of said resilient members, whereby each said upper cutting edge cooperates with said cutting edge of the respective said pin hole to punch a notch in a respective edge of the film, and to press the film toward said film support.

7. A splicing gauge as claimed in claim 6, further comprising another film presser arm pivotally mounted on said film support for pressing the film toward said punching pins, and a biasing member urging said film presser arm and said another film presser arm to pivot in opposite directions, whereby when said film presser arm is pivoted toward the film against the biasing force of said biasing member said biasing force pivots said another film presser arm to press the film toward said film support, and further pivoting of said film presser arm causes said film presser arm to press said punching pins.

* * * * *